US006523211B2

(12) United States Patent
Wang

(10) Patent No.: US 6,523,211 B2
(45) Date of Patent: Feb. 25, 2003

(54) SELF-WRINGING MOP WITH ROTATING OFFSET

(76) Inventor: Xiaoping Wang, 7316 Geyer Springs Rd., Little Rock, AR (US) 72209

( * ) Notice: Subject to any disclaimer, the term of this patent is extended or adjusted under 35 U.S.C. 154(b) by 20 days.

(21) Appl. No.: 09/805,964

(22) Filed: Mar. 14, 2001

(65) Prior Publication Data

US 2002/0129457 A1 Sep. 19, 2002

(51) Int. Cl.[7] ..... A47L 13/142
(52) U.S. Cl. ..... 15/120.2
(58) Field of Search ..... 15/116.1, 119.1, 15/120.1, 120.2

(56) References Cited

U.S. PATENT DOCUMENTS 1,029,436 A * 6/1912 Fuhrer
1,046,829 A * 12/1912 McCoy
1,062,984 A * 5/1913 McCoy
1,514,051 A * 11/1924 Jumonville
1,814,527 A 7/1931 Potter, Jr.
1,855,180 A * 4/1932 Byars
1,855,181 A * 4/1932 Byars
1,880,777 A * 10/1932 Byars
1,922,658 A * 8/1933 Byars
2,043,973 A * 6/1936 Nilson
2,185,502 A 1/1940 Fatland
2,495,846 A 1/1950 Johnson
4,178,650 A 12/1979 Aasland

* cited by examiner

*Primary Examiner*—Terrence R. Till
(74) *Attorney, Agent, or Firm*—Sturm & Fix LLP

(57) ABSTRACT

A self-wringing mop is disclosed comprising a mop stick, an "H" shape frame having one side slidably but not rotatably attached to the mop stick and the other side connected to a short rotating offset that is spaced around five (5) inches apart from the mop stick. A mop head in the form of a bundle of threads has one end connected to the lower end of the mop stick and the other end connected to the lower end of the rotating offset. By turning the driving handle on the rotating offset even a large-size mop head that is more difficult to wring, can be wrung quickly and efficiently.

17 Claims, 3 Drawing Sheets

SELF-WRINGING MOP WITH ROTATING OFFSET

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of cleaning devices, and more particularly to a self-wringing mop.

2. Description of Related Art

As can be seen by reference to the following U.S. Pat. Nos. 1,814,527; 2,185,502; 2,495,846 and 4,178,650, the prior art is replete with myriad and diverse wringer mops.

The device known as the self-wringing mop has been developed for years. Some of its variations have been sold successfully in the market. The variations can be divided into two categories. The design of the first category has a piece of sponge as the absorbent mop head. This design is only good for light-duty cleaning jobs because a sponge is not suitable for picking up large quantities of dirt at one time, hence the user has to rinse and wring it many times to complete a cleaning job. Also, a sponge is easily worn out of rough surfaces. The design of the second category has a mop head made of some threadlike absorbent fabric. The threadlike fabric can pick up more dirt than a sponge and is less likely to wear out. Therefore, it is a better choice for heavy-duty cleaning jobs. However, the prior designs of the self-wringing mop using threadlike fabric have the following drawbacks.

1. In the prior designs of the self-wringing mop, the mop has a sleeve axially and rotatably movable on the mop stick. To wring the mop, the sleeve is slid up and is rotated on the mop stick. The result is that the mop fabric is wrapped around the stick and is pressed against the stick. As the mop fabric is wrapped around the stick, the mop head will contaminate the lower part of the mop stick with the rinsing water. With the sleeve being slide up and down repeatedly in the mopping process, the rinsing water will be spread out gradually on the mop stick until all the area of the stick surface where the sleeve is slid on is contaminated. Thus, it is unavoidable for the user's hands to be contaminated.

2. In the prior design of the self-wringing mop, the mopping fabric is not twisted in a natural way like a towel being twisted by hand, but instead is wrapped around the mop stick. It is common sense that a piece of fabric dries less while being twisted with a hard object wrapped in it than being twisted alone. The reason is that in the latter case, the fabric has a smaller diameter and a fabric with a smaller diameter can be dried with a small twisting force. Also, in the latter case, the fabric being twisted is tightened more evenly due to the overall softness of the fabric. Moreover, since the fabric is wrapped around the mop stick, the friction between the stick and the fabric will be against the twisting movement of the fabric. The twisting force that the user applied to the fabric in wringing the mop will be counterbalanced by the friction. As a result, the further a section of the mopping fabric is from the rotating sleeve in the wringing process, the poorer the drying result for the section will be. Thus, the prior self-wringing mops are difficult to wring, particularly for those who have weak hand strength. As a result, the mop head is not adequately dried.

3. As described in 1 above for the prior designs of the self-wringing mop, the mop head contaminates the mop stick. Therefore, the mopping fabric has to be relatively short although the longer mopping fabric is highly desirable for the better mopping effect, since otherwise a large percentage of the surface of the mop stick will be heavily contaminated. Another reason for the mopping fabric to be relatively short is, as described in 2 above, that the friction between the stick and the fabric counter balances the twisting force the user applies to the fabric. Thus, the part of the fabric that is relatively far away from the sleeve will be poorly dried. If a very long mopping fabric is mounted on the mop, it Will be practically impossible to be dried properly.

4. As described in 2 above, the prior self-wringing mops are difficult to wring. Additionally, the method of wringing the mop is cumbersome and time consuming. The wringing of the mop requires changes of the grip. When the grip is shifted from one grip to another, the fabric will bounce back and lose its prior tightness. The overall difficulties in wringing the mop restrict the possibility of using a thicker mop head in the mop.

5. The combination of drawbacks 3 and 4 above make it difficult for a prior self-wringing mop to have a large-size mop head and, therefore, restricts its use in heavy-duty jobs.

All of the aforementioned prior art constructions are uniformly deficient with respect to their failure to provide a simple, efficient and practical self-wringing mop.

As a consequence of the foregoing situation, there has existed a longstanding need for a new and improved self-wringing mop and the provision of such a construction is a stated objective of the present invention.

BRIEF SUMMARY OF THE INVENTION

The purpose of the present invention is to provide a solution to the above-described problems. The design of the present invention introduces a mop structure substantially different from all the prior designs. The new design includes a mop stick and an "H" shape frame with one end slidably but not rotatably attached to the mop stick. The mop stick has an oval shape cross-section. The special shape of the mop stick prevents the frame from rotating on the mop stick. There is a rotating offset or a shaft attached to the other end of the frame. The shaft has a driving handle perpendicular to it. By rotating the driving handle, the shaft can be turned on the frame. The mop head has two ends. One end is attached to the lower end of the shaft. The other end is attached to a short shaft fastened on the lower end of the mopping stick.

When the frame is lifted up, the mop stick will slide down by gravity. Since the mopping fabric is fastened between the lower end of the mopping stick and the lower end of the rotating offset, it will stretch out like a tightened rope. Then the user can wring the mop by holding the frame while turning the driving handle of the rotating offset. The mopping fabric will be twisted in a way just like a towel being twisted by hand. Instead of being wrapped on the mop stick, the mopping fabric will be twisted alone without touching the mop stick in the wringing process.

When the frame is slid down, the mop stick and the rotating offset will have their lower ends positioned side-by-side and the mopping fabric will form a ready-to-use "U" shape mop head.

The present invention has the following advantages over the prior designs.

1. Since the mopping fabric is not wrapped around the mop stick but is twisted like a towel being twisted by hand, a much smaller strength is needed to wring the mop and the drying effect is greatly improved. Also, since there is no friction counter balancing the twisting force, a much longer mopping fabric can be used without having a negative impact on the drying effect.

2. Since the mopping fabric is not wrapped around the mop stick but is apart from the mop stick in the wringing process, the rinsing water will not contaminate the mop stick. Thus, the user's hand will be kept clean.

3. Since the mopping head does not contaminate the mopping stick and the wringing mechanism guaranties the great drying effect no matter how long the mopping fabric will be, there is very little limitation for the length of the mopping fabric. Thus, the mopping fabric can be made very long to achieve the best mopping result.

4. Since the mopping fabric is not wrapped around the mop stick but is twisted like a towel being twisted by hand, the drying effect is greatly improved. Also, the driving handle perpendicular to the rotating offset makes it easy to apply a greater driving torque in twisting the mopping fabric. Thus, mop heads with greater diameters can be easily dried with the wringing mechanism.

5. The combination of advantages 3 and 4 above makes it possible for a self-wringing mop to have a long and thick, large-size mop head. Thus, in addition to the light-duty use, a self-wringing mop can also be used for heavy-duty jobs.

6. By rotating the driving handle of the rotating offset in a continuous circular manner, the wringing of the mop is simple, easy and fast without the inconvenience of changes of the grip.

7. Due to the structure of the mop, the mopping fabric will not tangle up. Thus, the fabric can be made simply as a coil of threads without the extra complexity of some anti-tangle designs occurring in the designs of some prior self-wringing mops.

8. The fact that the mop can have a mop head substantially larger than the mop heads of prior self-wringing mops does not mean that it cannot have a smaller mop head for household use. Based on the same design, a mop of a reduced size can be made to have smaller mop head. Then due to the efficiency of the wringing mechanism, there will be much improved wringing effect with less hand strength required to wring the mop.

BRIEF DESCRIPTION OF THE SEVERAL VIEWS OF THE DRAWINGS

As best shown in FIG. 1, the lower portion of the second end of the mop stick 2 is spaced further away from the longitudinal axis of the mop stick 2 than the lower end of the mop stick 2, and the lower portion of the second end is spaced apart from the lower end of the mop stick 2.

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
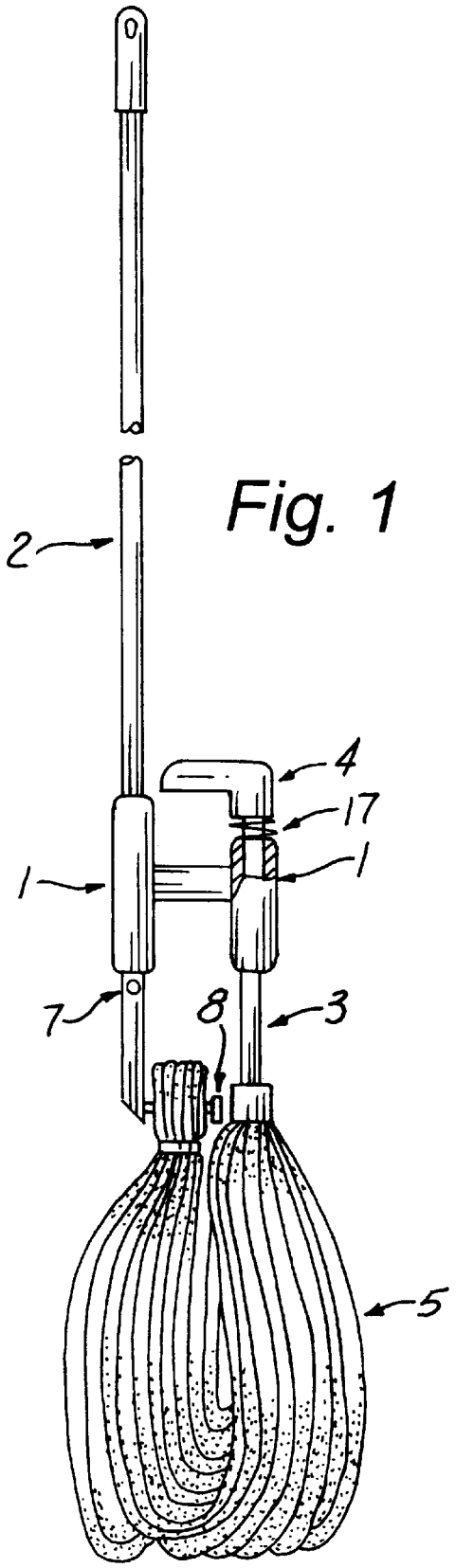
FIG. 1 is a perspective view showing the self-wringing mop of the present invention with the rotating offset in the lowered mopping position.

As can be seen by the reference to the drawings and in particular to FIG. 1, the self-wringing mop includes a mop stick 2, a H-shaped connector frame 1, a rotating offset 3 and a mopping fabric 5. One side of the frame 1 is slidable but not rotatable on the mop stick 2. The frame 1 cannot rotate on the mop stick 2 because the mop stick 2 has an oval shaped cross-section that matches the shape of a hole on the frame 1 where the mop stick slides through. The rotating offset 3 is attached to the other side of the frame 1. By rotating the driving handle 4, the rotating offset 3 can be turned on the frame 1. On the mop stick 2, there is a plug 7 that stops the downward movement of the frame 1. On the lower end of the mop stick 2 there is a shaft 8. The mopping fabric 5 is attached between the lower end of the rotating offset 3 and the shaft 8.

The self-wringing mop has two basic positions; i.e., the mopping position and the wringing position. FIG. 1 shows the mopping position of the mop. When frame 1 is slid down, the plug 7 will stop the downward movement of the frame 1. The rotating offset 3 and the mop stick 2 will have their lower ends positioned side-by-side. The mopping fabric 5 will form an easy-to-use "U" shape mop head.

Figure 2:
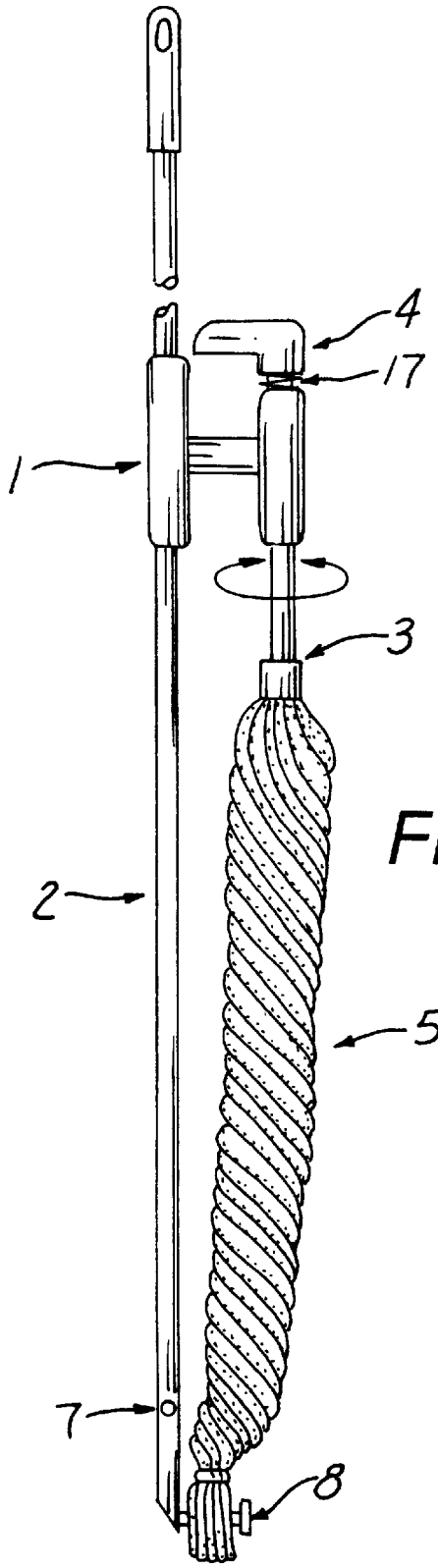
FIG. 2 is a perspective view similar to FIG. 1, but showing the rotating offset in the raised wringing position.

FIG. 2 shows the wringing position of the mop. When a user lifts the frame 1, the frame 1 will be slipped up until the mop fabric 5 stretches out like a tightened rope. Then the user can wring the mop by holding the frame 1 while rotating the driving handle 4 to turn the rotating offset 3. The mop fabric 5 will be twisted in the same way as a towel being twisted. When the wringing process is finished, the user can release the driving handle 4, let the mopping fabric 5 bounce backward to unwind the mop head and then lower the frame 1. The mop then returns to the mopping position.

Figure 3:
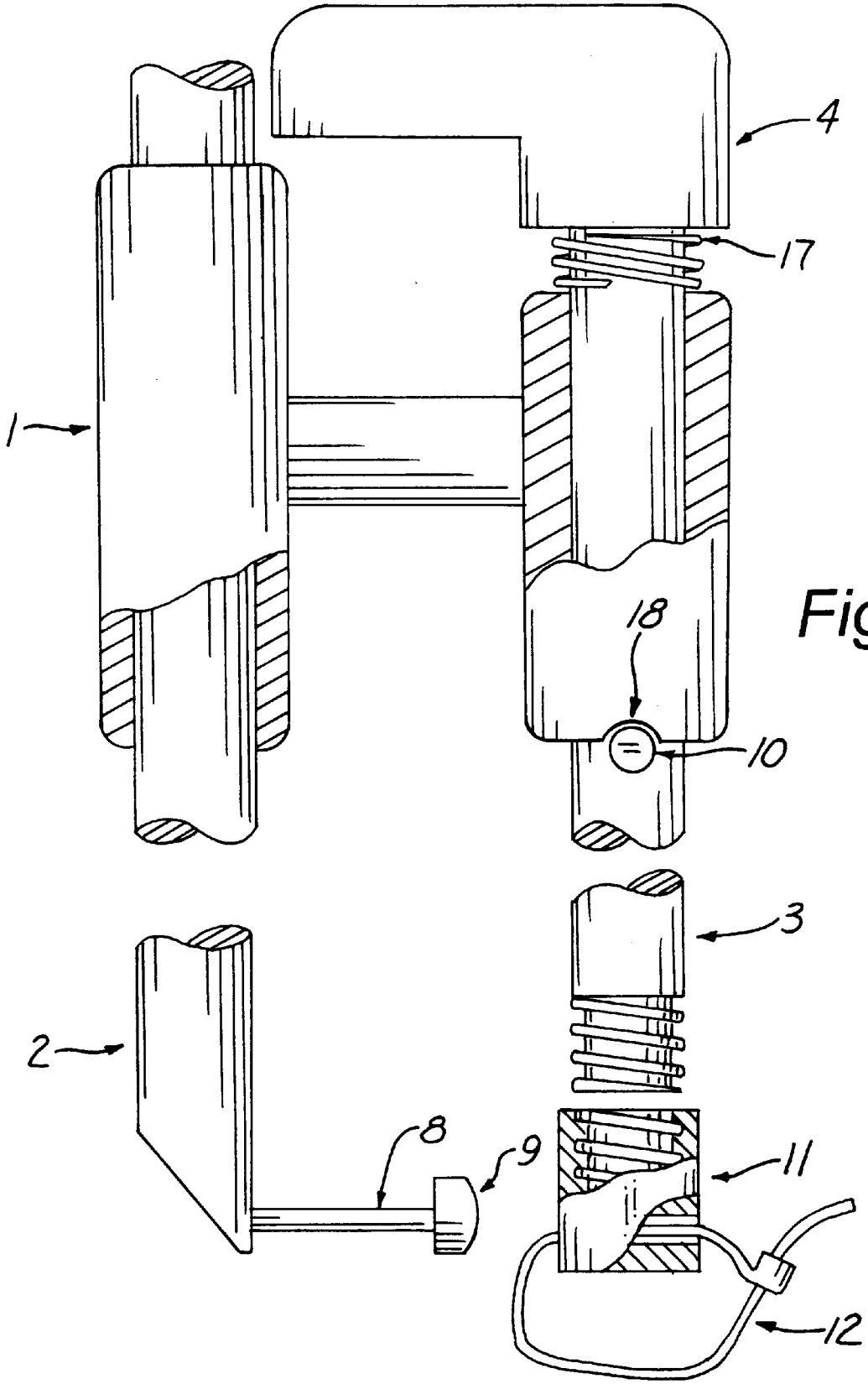
FIG. 3 is an enlarged partial sectional view showing the H-shape frame, the rotating offset, the driving handle of the rotating offset, the lower end of the mop stick, and the lower end of the rotating offset.
Figure 4:
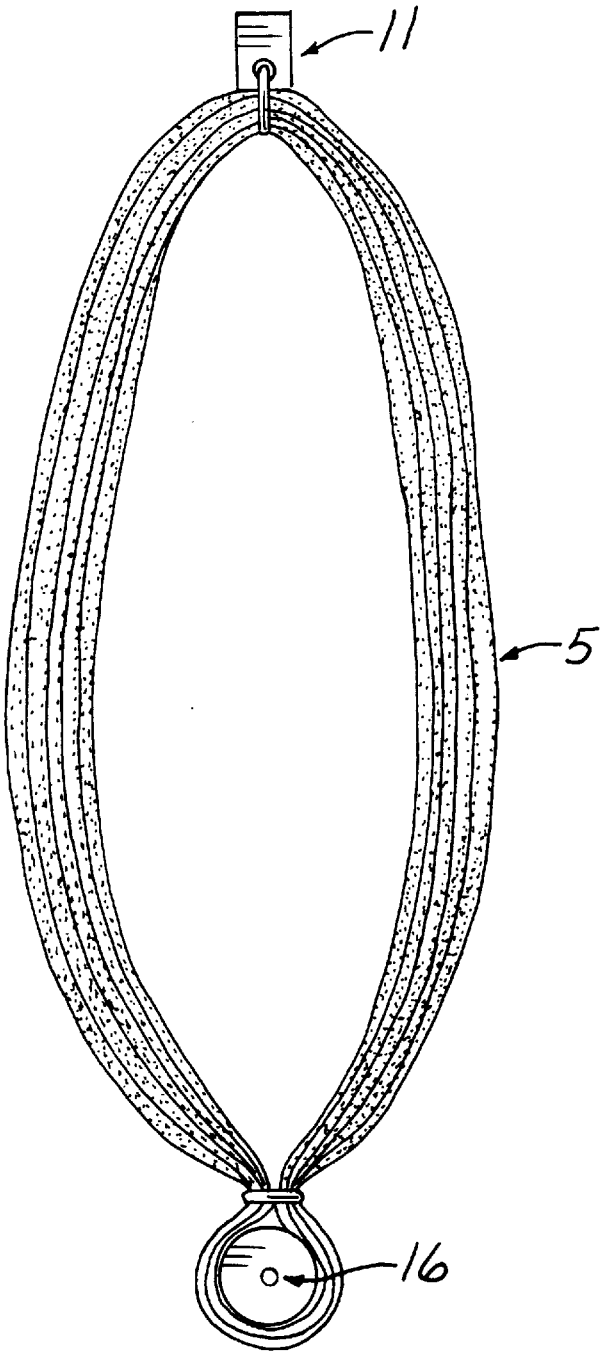
FIG. 4 is a side perspective view showing the threaded connector attached at one end and the reel attached at the other end of the mopping fabric.
Figure 5:
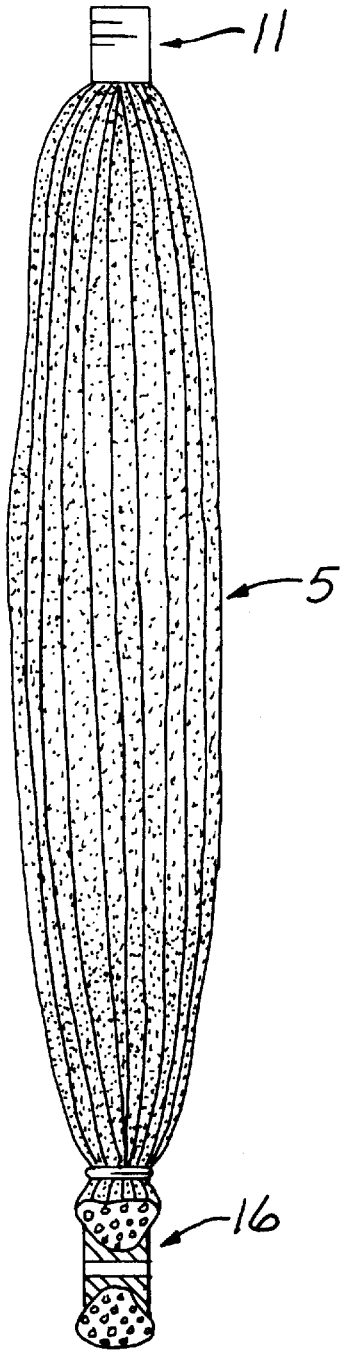
FIG. 5 is a front perspective view of the mopping fabric with the threaded connector and reel attached.

FIG. 3 shows the structure of the frame 1 in detail. The shaft 8 is fastened on the lower end of the mop stick 2. The part 9 is a plastic nut screwed on the end of the shaft 8 for fastening the mop head on the shaft 8. The connector 11 is for fastening the mop head to the lower end of the rotating offset 3. The end of the rotating offset 3 has male threads on it and the connector 11 has female threads. The connector 11 then is screwed on the rotating offset 3. On the other end of the connector 11 there is a hole and a cable tie 12 penetrating through the hole for tying the mopping fabric 5 on the connector 11. FIGS. 4 and 5 show the way the mopping fabric 5 is tied on the connector 11.

The plug 10 shown in FIG. 3 has two functions. One is to keep the rotating offset 3 from sliding axially upward on the frame 1. Another function is to secure the position of the driving handle 4 so the end of the driving handle 4 will point toward the mop stick 2 when the mop is in the mopping position. The purpose of this arrangement is to make the frame 1, including the driving handle 4, fit in a smaller space so the driving handle 4 will have less chance to hit other objects in a mopping process. On the lower edge of the second end of the frame 1 there is a hollow 18. The spring 17 is to force the rotating offset 3 to slide upward so the plug 10 will slide into the hollow 18 when the driving handle 4 is turned to point toward the mop handle 2. In that way, the driving handle 4 will be kept in such a position throughout a mopping process.

It is clear from FIG. 3 that the driving handle 4 can only be turned in a pre-decided direction to wring the mop. If a relatively large turning force is applied to the handle 4 in the opposite direction, the connector 11 will be screwed off from the rotating offset 3. This provides a convenient way to change the mop head. A user needs only to turn the driving handle 4 opposite to the wringing direction and to unscrew the plastic nut 9 from the shaft 8, the old mop head will come off and a new mop head can be put on using the reverse procedure.

FIGS. 4 and 5 show the structure of the mop head. The mopping fabric 5 is basically a coil of threads or a bundle of thread loops. Various absorbent fabrics such as coarsely fabricated cotton material may be used as the mopping fabric. One end of the mopping fabric 5 is fastened on a reel 16. The reel 16 has a hole in the center for rotatably attaching to the shaft 8. The reel can freely rotate on the shaft 8 when the mop is switched between the mopping position and the wringing position. The other end of the mopping fabric 5 is tied on the connector 11 with a cable tie 12.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A self-wringing mop, comprising:

an elongated mop stick having a longitudinal axis, an upper end, and a lower end;

a connector frame having a first end slidably attached to the mop stick and a second end offset from and rotatable with respect to the longitudinal axis of the mop stick, the connector frame being movable between a lowered mopping position wherein a lower portion of its second end is disposed adjacent to and offset from the lower end of the mop stick such that the lower portion of its second end as spaced further away from the longitudinal axis of the mop stick than the lower end of the mop stick and the lower portion of its second end is spaced apart from the lower end of the mop stick, and a raised wringing position wherein its first end is disposed above the lower end of the mopping stick;

a mopping fabric having one end attached to the lower end of the mopping stick and another end attached to a lower portion of the second end of the connector frame; and a plug attached to the mop stick and being disposed to contact and limit the downward movement of the connector frame when it is in the lowered mopping position.

2. The self-wringing mop of claim 1 wherein the lower end of the mopping stick includes a shaft, and the one end of the mopping fabric is rotatably attached by a reel secured to the shaft.

3. The self-wringing mop of claim 2 wherein the lower portion of the second end of the connector frame includes a threaded end, and the other end of the mopping fabric is attached by a complementary threaded connector and an attached cable tie.

4. The self-wringing mop of claim 1 wherein the lower end of the mopping stick includes a shaft, and the one end of the mopping fabric is rotatably attached by a reel secured to the shaft.

5. The self-wringing mop of claim 4 wherein the lower portion of the second end of the connector frame includes a threaded end, and the other end of the mopping fabric is attached by a complementary threaded connector and an attached cable tie.

6. The self-wringing mop of claim 1 wherein the lower portion of the second end of the connector frame includes a threaded end, and the other end of the mopping fabric is attached by a complementary threaded connector and an attached cable tie.

7. The self-wringing mop of claim 1 wherein the lower portion of the second end of the connector frame includes a threaded end, and the other end of the mopping fabric is attached by a complementary threaded connector and an attached cable tie.

8. The self-wringing mop of claim 1 wherein the second end of the connector frame carries a rotatable shaft with an attached driving handle disposed at the top of the rotatable shaft.

9. The self-wringing mop of claim 8 wherein the driving handle extends perpendicular to the rotatable shaft.

10. The self-wringing mop of claim 9 wherein the second end of the connector frame includes an alignment hollow disposed to engage an alignment plug on the rotatable shaft, wherein the driving handle is aligned to extend toward the mopping stick when the plug engages the hollow.

11. A self-wringing mop, comprising:

an elongated mop stick having a longitudinal axis, an upper end, and a lower end;

a connector frame having a first end slidably attached to the mop stick and a second end offset from and rotatable with respect to the longitudinal axis of the mop stick, the connector frame being movable between a lowered mopping position wherein a lower portion of its second end is disposed adjacent to and offset from the lower end of the mop stick, and a raised wringing position wherein its first end is disposed above the lower end of the mopping stick;

a mopping fabric having one end attached to the lower end of the mopping stick and another end attached to a lower portion of the second end of the connector frame; and a plug attached to the mop stick and being disposed to contact and limit the downward movement of the connector frame when it is in the lowered mopping position.

12. The self-wringing mop of claim 11 wherein the lower end of the mopping stick includes a shaft, and the one end of the mopping fabric is rotatably attached by a reel secured to the shaft.

13. The self-wringing mop of claim 12 wherein the lower portion of the second end of the connector frame includes a threaded end, and the other end of the mopping fabric is attached by a complementary threaded connector and an attached cable tie.

14. The self-wringing mop of claim 11 wherein the lower portion of the second end of the connector frame includes a threaded end, and the other end of the mopping fabric is attached by a complementary threaded connector and an attached cable tie.

15. The self-wringing mop of claim 11 wherein the second end of the connector frame carries a rotatable shaft with an attached driving handle disposed at the top of the rotatable shaft.

16. The self-wringing mop of claim 15 wherein the driving handle extends perpendicular to the rotatable shaft.

17. The self-wringing mop of claim 16 wherein the second end of the connector frame includes an alignment hollow disposed to engage an alignment plug on the rotatable shaft, wherein the driving handle is aligned to extend toward the mopping stick when the plug engages the hollow.

* * * * *